US010744510B1

(12) United States Patent
Plemmons

(10) Patent No.: US 10,744,510 B1
(45) Date of Patent: Aug. 18, 2020

(54) GUTTER DEBRIS-GRINDING DEVICE

(71) Applicant: Clay Plemmons, Candler, NC (US)

(72) Inventor: Clay Plemmons, Candler, NC (US)

( * ) Notice: Subject to any disclaimer, the term of this patent is extended or adjusted under 35 U.S.C. 154(b) by 326 days.

(21) Appl. No.: 15/967,708

(22) Filed: May 1, 2018

(51) Int. Cl.
*B02C 18/24* (2006.01)
*B02C 25/00* (2006.01)
*B02C 23/36* (2006.01)
*E04D 13/076* (2006.01)

(52) U.S. Cl.
CPC ..... *B02C 18/24* (2013.01); *B02C 23/36* (2013.01); *B02C 25/00* (2013.01); *E04D 13/076* (2013.01)

(58) Field of Classification Search
CPC ..... B02C 18/24; B02C 18/38; B02C 25/00; B02C 23/36; E04D 13/064–08
USPC ..... 241/46.017, 277; 52/16
See application file for complete search history.

(56) References Cited

U.S. PATENT DOCUMENTS 1,687,728 A * 10/1928 Liddell ..... E01H 1/053 15/87
2,917,767 A * 12/1959 Lechene ..... A46B 13/008 15/180
2,996,742 A * 8/1961 Aimers ..... E01H 1/053 15/87
3,023,441 A * 3/1962 Lechene ..... A46B 13/008 15/198
3,638,369 A * 2/1972 Albrecht ..... E04D 13/08 52/16
4,168,559 A * 9/1979 Henson ..... E04D 13/0765 15/23
4,241,547 A * 12/1980 Bove' ..... E04D 13/076 52/11
4,602,460 A * 7/1986 Langenbach ..... E04D 13/08 15/104.095
4,958,397 A * 9/1990 Ryan ..... A46B 13/02 15/23
D482,433 S 11/2003 Sawyer
7,469,504 B2 12/2008 Nocella
7,568,640 B2 * 8/2009 Rademacher ..... E04D 13/076 241/21
7,883,038 B2 * 2/2011 Migliaccio ..... E04D 13/0767 241/282.1
7,909,274 B2 * 3/2011 Migliaccio ..... E04D 13/0767 241/282.2
8,574,037 B2 * 11/2013 Kresge ..... B24B 27/027 451/344

(Continued)

FOREIGN PATENT DOCUMENTS

WO 20133028883 2/2013

*Primary Examiner* — Shelley M Self
*Assistant Examiner* — Smith Oberto Bapthelus
(74) *Attorney, Agent, or Firm* — Kyle A. Fletcher, Esq.

(57) ABSTRACT

The gutter debris-grinding device attaches to a rain gutter directly above a downspout. A float switch attached to a float in the gutter senses when water is collecting in the gutter instead of draining through the downspout. The float switch may trigger a grinder motor to turn on, causing rotation of a grinder blade at the end of a grinder shaft located above the downspout. The float switch may also trigger an elevation motor to lower the grinder motor by rotating a leadscrew, causing the grinder blade to cut and/or break debris that may be blocking the entrance to the downspout. Upon sensing that the water level has gone down, or after a predetermined time interval, the grinder motor may be raised and the grinder blade may be stopped.

20 Claims, 5 Drawing Sheets

(56) References Cited

U.S. PATENT DOCUMENTS

| | | | | |
|---|---|---|---|---|
| 8,607,778 | B1 | 12/2013 | Sonne | |
| 2008/0066391 | A1* | 3/2008 | Rademacher | E04D 13/076 52/12 |
| 2009/0193723 | A1* | 8/2009 | Migliaccio | E04D 13/0645 52/12 |
| 2009/0283618 | A1* | 11/2009 | Migliaccio | E04D 13/0645 241/62 |

* cited by examiner

GUTTER DEBRIS-GRINDING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of home maintenance, more specifically, a gutter debris-grinding device.

SUMMARY OF INVENTION

The gutter debris-grinding device attaches to a rain gutter directly above a downspout. A float switch attached to a float in the gutter senses when water is collecting in the gutter instead of draining through the downspout. The float switch may trigger a grinder motor to turn on, causing rotation of a grinder blade at the end of a grinder shaft located above the downspout. The float switch may also trigger an elevation motor to lower the grinder motor by rotating a leadscrew, causing the grinder blade to cut and/or break debris that may be blocking the entrance to the downspout. Upon sensing that the water level has gone down, or after a predetermined time interval, the grinder motor may be raised and the grinder blade may be stopped.

An object of the invention is to provide a rotating grinder blade that may cut and/or break debris blocking the entrance to a downspout Another object of the invention is to sense said blockage using a float switch.

A further object of the invention is to provide an elevation motor to raise and lower the grinder blade.

Yet another object of the invention is to provide electrical energy to the device from one or more batteries that are recharged using solar energy.

These together with additional objects, features and advantages of the gutter debris-grinding device will be readily apparent to those of ordinary skill in the art upon reading the following detailed description of the presently preferred, but nonetheless illustrative, embodiments when taken in conjunction with the accompanying drawings.

In this respect, before explaining the current embodiments of the gutter debris-grinding device in detail, it is to be understood that the gutter debris-grinding device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the gutter debris-grinding device.

It is therefore important that the claims be regarded as including such equivalent construction insofar as they do not depart from the spirit and scope of the gutter debris-grinding device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
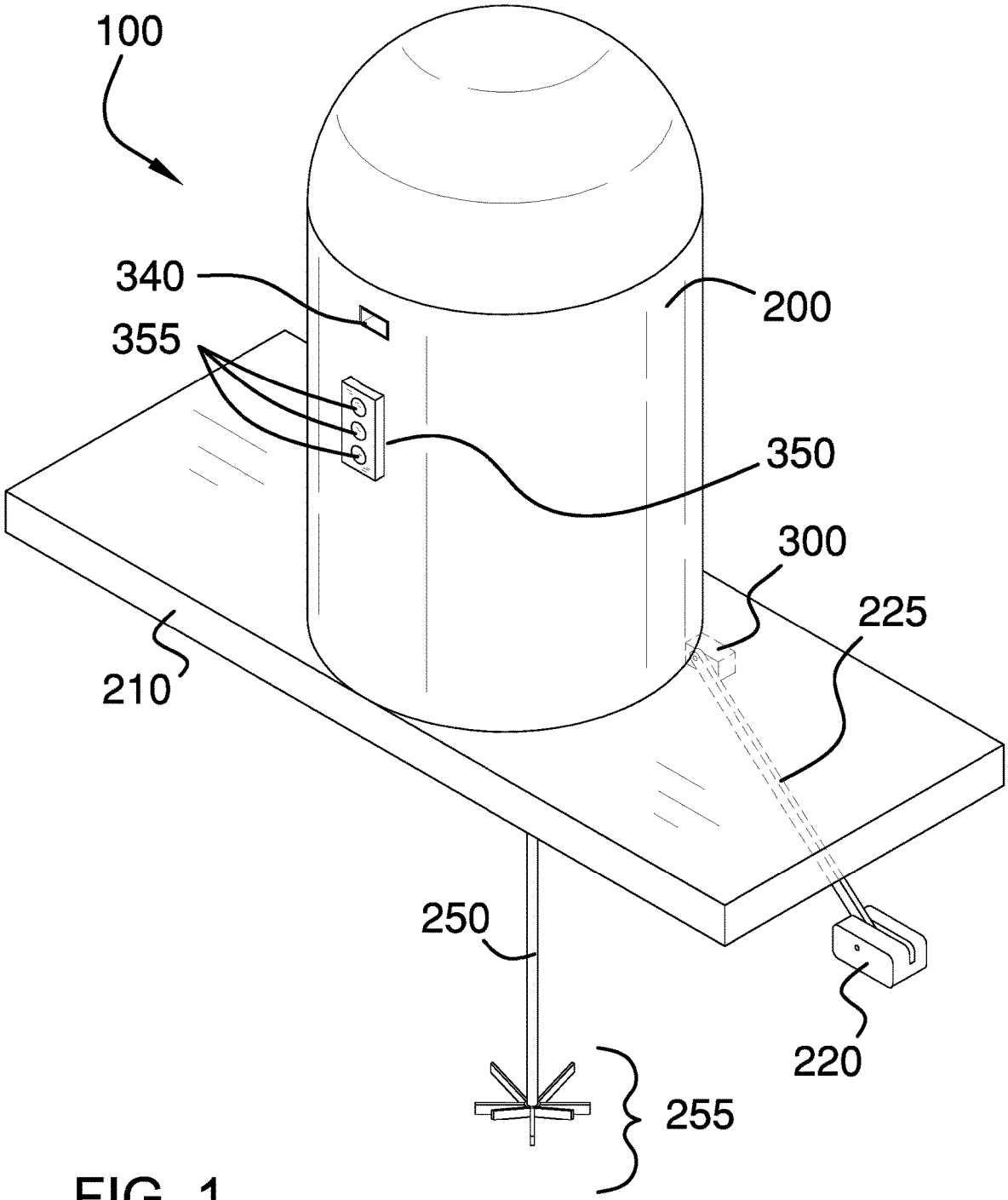
FIG. 1 is a perspective view of an embodiment of the disclosure.
Figure 2:
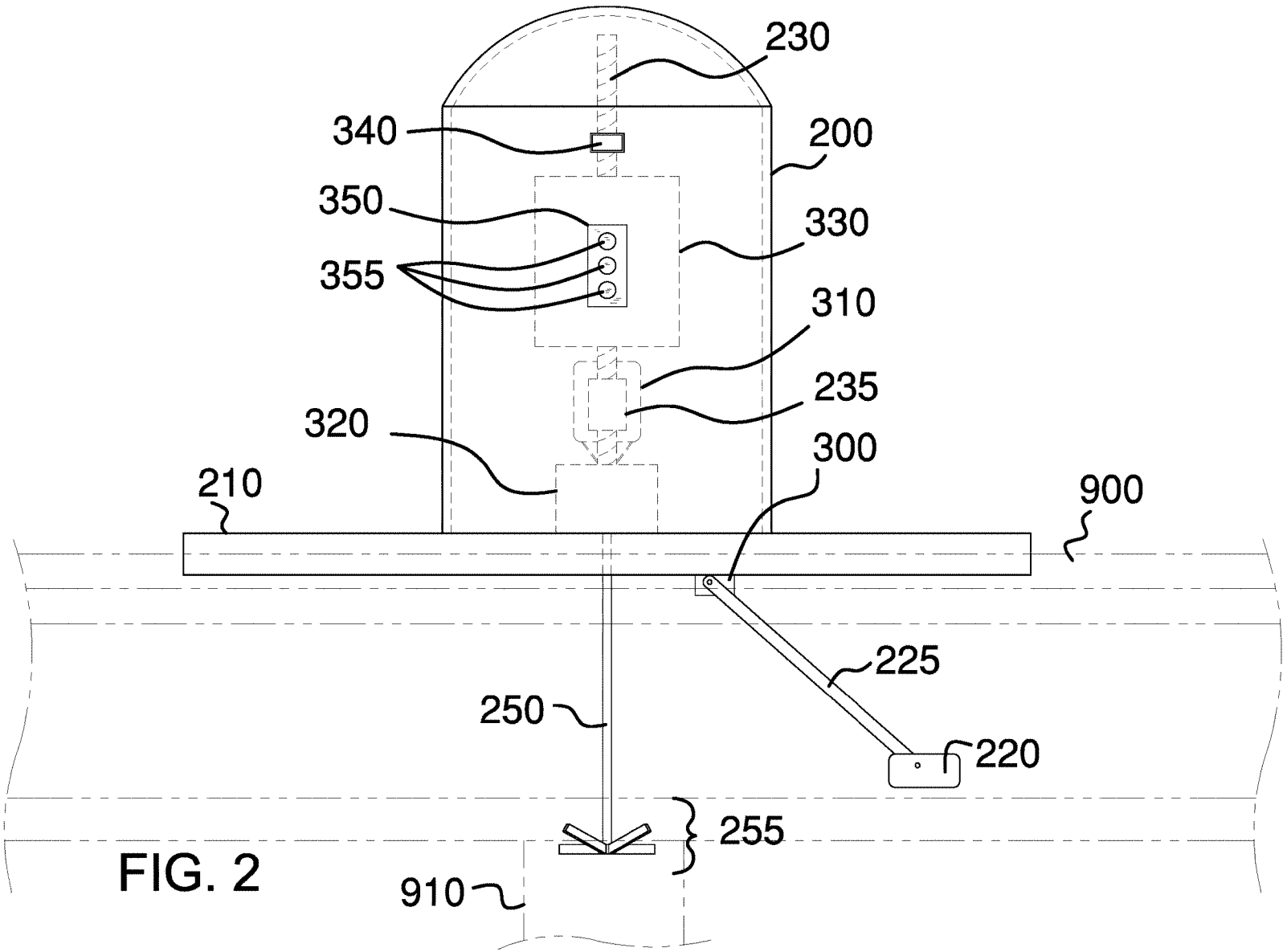
FIG. 2 is a front view of an embodiment of the disclosure.
Figure 3:
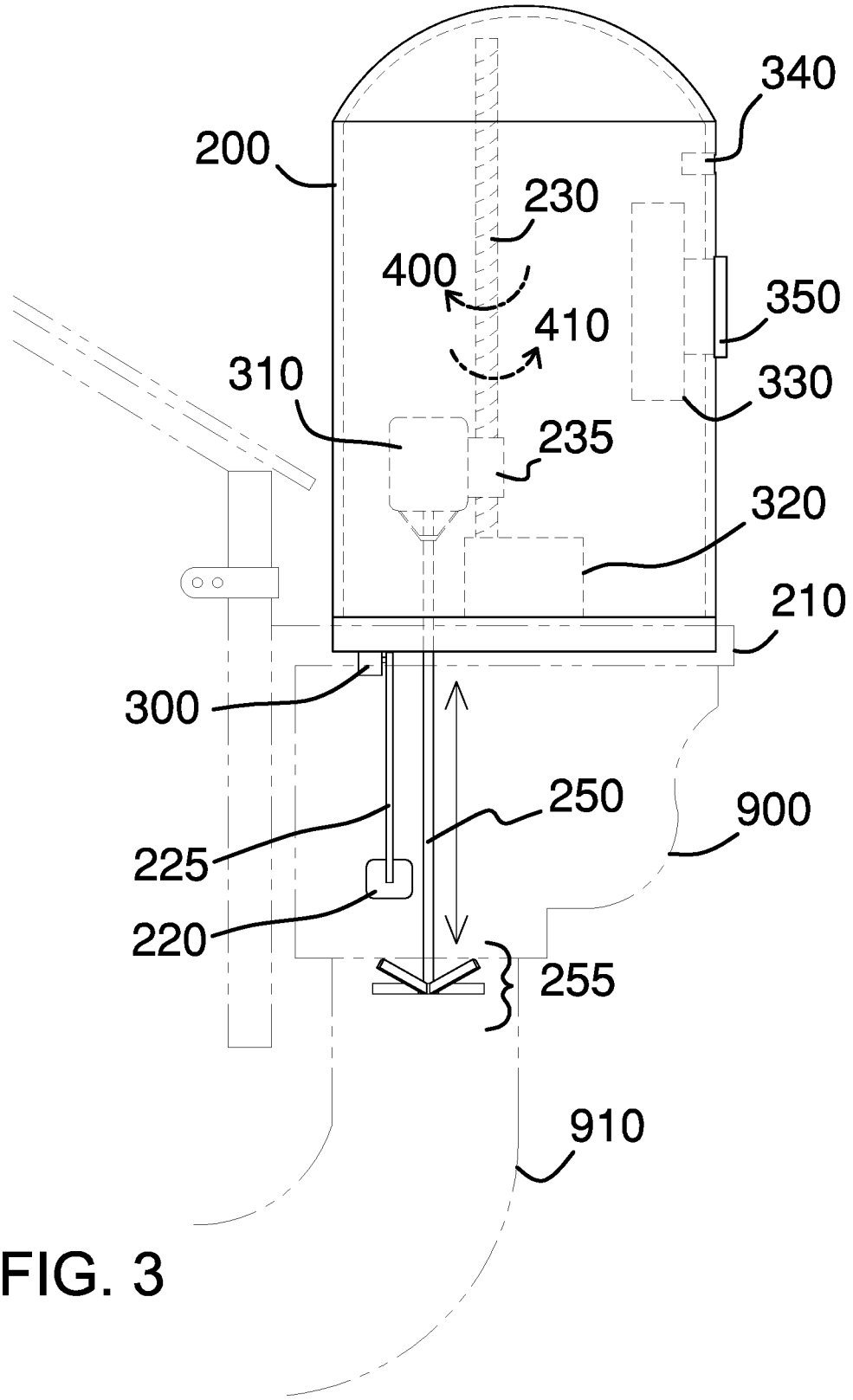
FIG. 3 is an in-use view of an embodiment of the disclosure illustrating the grinder blade lowered.
Figure 4:
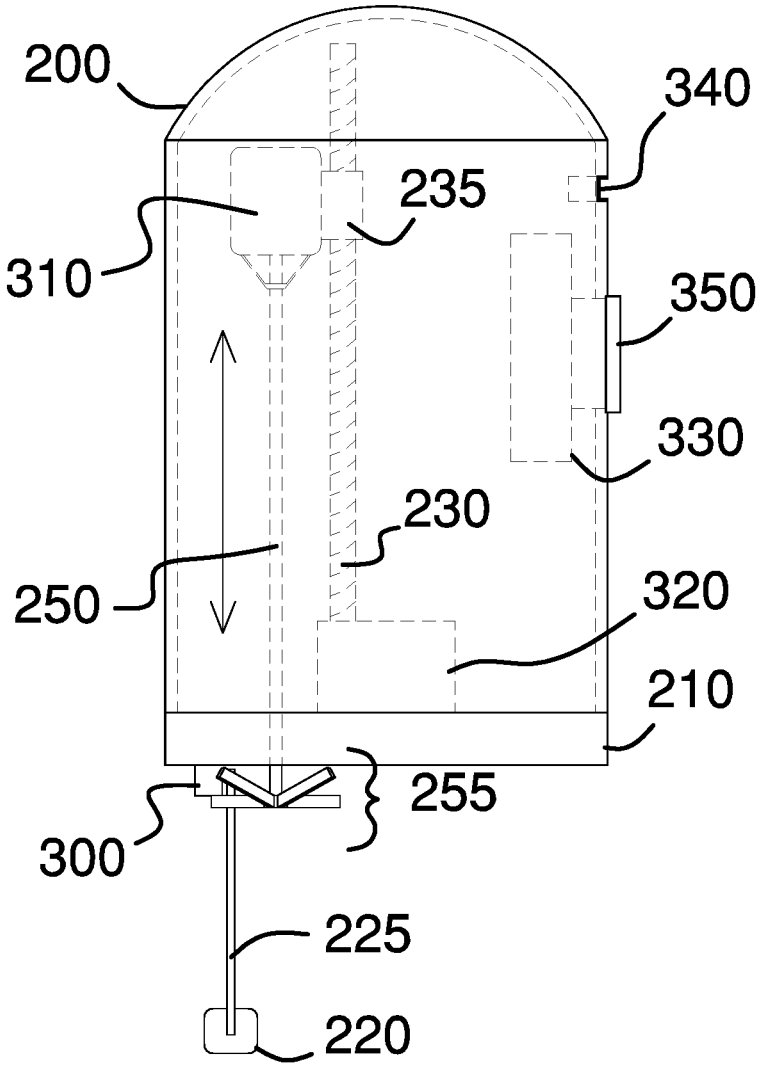
FIG. 4 is a side view of an embodiment of the disclosure.
Figure 5:
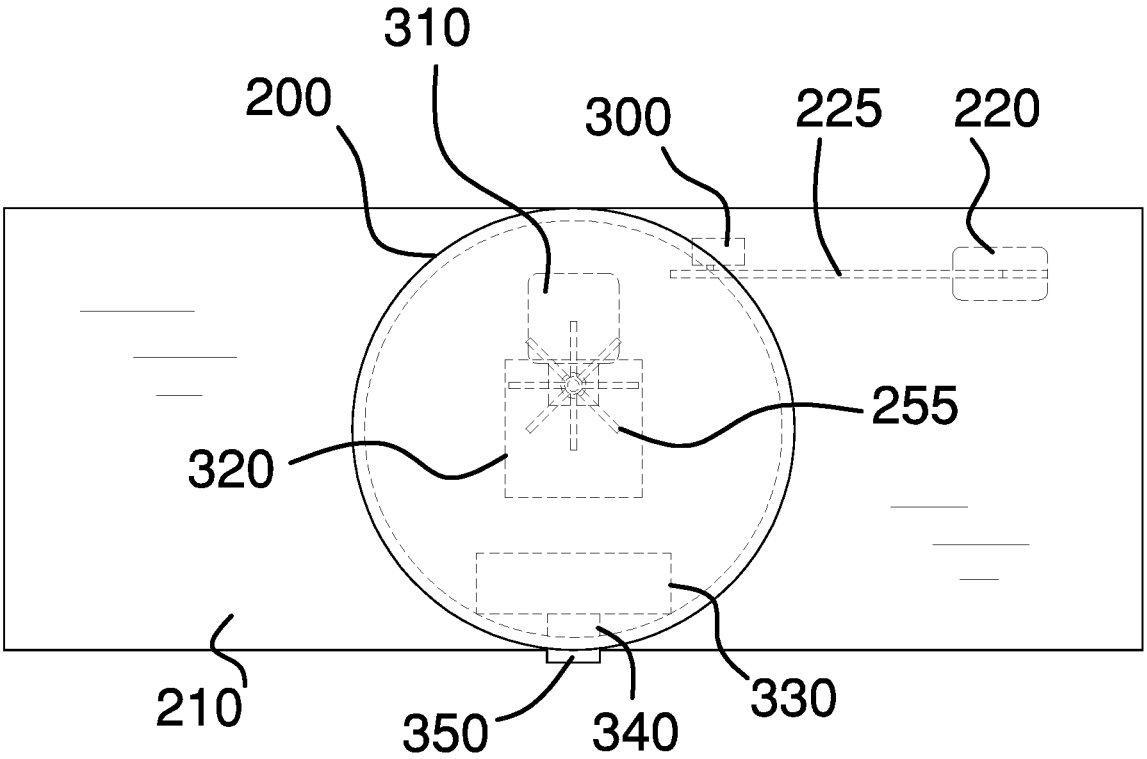
FIG. 5 is a top view of an embodiment of the disclosure.

Detailed reference will now be made to a first potential embodiment of the disclosure, which is illustrated in FIGS. 1 through 5.

The gutter debris-grinding device 100 (hereinafter invention) comprises a grinder, a lifter, a float, a float switch 300, a housing 200, a mounting plate 210, a control panel 350, and a battery 330. The invention 100 is a tool that comminutes debris (not illustrated in the figures) blocking a downspout 910. The invention 100 couples to a rain gutter 900 above the downspout 910 and may lower a grinder blade 255 into the downspout 910 when the float switch 300 indicates that the downspout 910 is blocked.

The grinder comprises a grinder motor 310, a grinder shaft 250, and the grinder blade 255. The grinder may spin the grinder blade 255 at the end of the grinder shaft 250, causing the debris to be comminuted.

The grinder motor 310 may convert electrical energy into mechanical energy. The grinder motor 310 may cause rotation of the grinder shaft 250 when electrical energy is applied to the grinder motor 310. The electrical energy applied to the grinder motor 310 may be controlled by the control panel 350. The grinder motor 310 may be coupled to a grinder motor mount 235 such that vertical movement of the grinder motor mount 235 may raise and lower the grinder motor 310. The grinder motor 310 may be positioned such that the axis of rotation of an elevation motor 320 is vertically oriented. A central axis of the grinder motor 310 may protrude from the grinder motor 310 on the bottom of the grinder motor 310.

The grinder shaft 250 may couple to or may be an extension of the grinder motor 310. The lower end of the grinder shaft 250 may couple to the grinder blade 255 such that when the grinder motor 310 rotates, the grinder shaft 250 will cause the grinder blade 255 to spin.

The grinder blade 255 may be a central hub coupled to a plurality of horizontally oriented tines and/or blades. The rotary motion of the grinder blade 255 caused by the grinder motor 310 combined with the linear up and down motion of the grinder blade 255 caused by the elevation motor 320 may cause the grinder blade 255 to cut and/or break the debris that it comes into contact with. As the grinder blade 255 is moved up and down in the rain gutter 900 and the downspout 910, the grinder blade 255 may eliminate the debris that is clogging the downspout 910.

The lifter comprises the elevation motor 320, a leadscrew 230, and the grinder motor mount 235. The lifter may lower the grinder when the float switch 300 indicates that the downspout 910 is blocked and may raise the grinder when the float switch 300 indicates that the downspout 910 is not blocked.

The elevation motor 320 may convert electrical energy into mechanical energy. The elevation motor 320 may cause rotation of the leadscrew 230 when electrical energy is applied to the elevation motor 320. The electrical energy applied to the elevation motor 320 may be controlled by the control panel 350. The elevation motor 320 may be coupled to the mounting plate 210 such that the axis of rotation of the elevation motor 320 is vertically oriented. A central shaft of the elevation motor 320 may be directly or indirectly coupled to the leadscrew 230.

The leadscrew 230 may be a threaded rod that is vertically oriented within the housing 200 of the invention 100. The leadscrew 230 may be coupled at its lower end to the elevation motor 320 and may be supported at it upper end by the housing 200 or support struts coupled to the housing 200. The leadscrew 230 may be threaded through the grinder motor mount 235 such that when the leadscrew 230 rotates the grinder motor mount 235 is forced to move up or down. The grinder motor mount 235 may move up if the leadscrew 230 is rotated in a first rotational direction 400. The grinder motor mount 235 may move down if the leadscrew 230 is rotated in a second rotational direction 410.

The grinder motor mount 235 may be a mount for the grinder motor 310 that raises and lowers the grinder motor 310 responsive to rotation of the leadscrew 230. The grinder motor mount 235 may couple to the side of the grinder motor 310. The grinder motor mount 235 may be slidably coupled to the leadscrew 230 via a vertically-oriented, threaded aperture in the grinder motor mount 235. The size and orientation of the thread within the grinder motor mount 235 may complement the size and orientation of the thread on the leadscrew 230 such that the grinder motor mount 235 is forced to move along the leadscrew when the leadscrew 230 rotates. The grinder motor mount 235 may be prevented from spinning around the leadscrew 230 as the leadscrew 230 rotates by one or more armatures (not illustrated in the figures) within the housing 200.

The float may be a buoyant object 220 coupled to the end of a float arm 225. The end of the float arm 225 opposite the buoyant object 220 may be coupled to the float switch 300. The float switch 300 may be coupled to the bottom of the mounting plate 210 such that the float is suspended above the rain gutter 900 when the rain gutter 900 is dry. The float may be oriented such that a lack of water in the rain gutter 900 may allow the buoyant object 220 to drop down and the presence of water in the rain gutter 900 may cause the buoyant object 220 to float up. The position of the buoyant object 220 may be sensed by the float switch 300 and may cause the float switch 300 to make or break an electrical circuit, indicating whether or not water is accumulating in the rain gutter 900.

The housing 200 may be an enclosure for the invention 100 and may protect the grinder motor 310, the elevation motor 320, and the battery 330 from the weather. The bottom of the housing 200 may be coupled to the mounting plate 210. In some embodiments, the housing 200 may be cylindrical in shape with a domed top. The mounting plate 210 may be a base for the invention 100. The mounting plate 210 may couple to the rain gutter 900 using clips, screws, wires, magnets, friction, or other fasteners. The mounting plate 210 may comprise an aperture for the grinder shaft 250 to pass through. The grinder blade 255, the float switch 300, the float arm 225, and the buoyant object 220 may be located below the mounting plate 210.

The control panel 350 may control the operation of the invention 100. Specifically, the control panel 350 may monitor the state of an input from the float switch 300 that indicates rising water in the rain gutter 900. Responsive to the indication of rising water, the control panel 350 may energize the grinder motor 310 and may energize the elevation motor 320, causing the grinder blade 255 to spin and to move down.

In some embodiments, the control panel 350 may periodically reverse the direction of rotation of the elevation motor 320 such that the grinder is both raised and lowered. The reversal of direction may be based upon a timing parameter, electrically sensing strain on the elevation motor 320 at the end of travel of the grinder motor mount 235, by sensing input from end of travel switches adjacent to the leadscrew 230, or a combination thereof.

The control panel 350 may cause the grinder motor 310 and the elevation motor 320 to operate until either the input from the float switch 300 indicates that the water has drained from the rain gutter 900 or until a preset time limit is reached. The control panel 350 may cause the elevation motor 320 to stop when the grinder blade 255 has reached its maximum height, to assure that the grinder blade 255 is out of the way of the water and the debris flowing through the rain gutter 900 and the downspout 910.

In some embodiments, the control panel 350 may comprise a processor and a memory wherein the memory contains instructions for causing the processor to control the sequence and timing of the operation of the invention 100.

In some embodiments, the control panel 350 may comprise one or more operator controls 355 for manually overriding the operation of the invention 100. As non-limiting examples, the one or more operator controls 355 may directly start or stop the grinder motor 310, directly start or stop the elevation motor 320, may reset the invention 100, or may initiate a self-test function.

The battery 330 may comprise one or more energy-storage devices. The battery 330 may be a source of electrical energy to operate the grinder motor 310, the elevation motor 320, and the control panel 350. The battery 330 may be replaceable or rechargeable. The battery 330 may be coupled, directly or indirectly, to a power connector 340 that is accessible on the outside of the housing 200. A solar panel (not illustrated in the figures) may be cabled to the power connector 340 to provide an electrical current to recharge the battery 330. The control panel 350, the grinder motor 310, the elevation motor 320, the power connector 340, the battery 330, and the float switch 300 may be interconnected using electrical wiring (not illustrated in the figures).

In use, the invention 100 is mounted to the rain gutter 900 above the downspout 910 by coupling the mounting plate 210 to the rain gutter 900 such that the grinder blade 255 is aligned with the downspout 910. The solar panel is cabled to the power connector 340 and the battery 330 Is allows to recharge. During inclement weather, water may enter the rain gutter 900 and flow to the downspout 910. If the downspout 910 is not clogged from the debris, the water will flow out and the buoyant object 220 will not float up. However, if the debris has clogged the entrance to the downspout 910, the water may start filling the rain gutter 900 and may cause the buoyant object 220 to float up. The float switch 300 may trigger the activation of the grinder motor 310 and the elevation motor 320, causing the grinder blade 255 to rotate and move down towards the downspout 910. The grinder blade 255 may encounter the debris and may comminute the clog. As the clog is removed, the water will flow into the downspout 910 and the buoyant object 220 will drop. Eventually the float switch 300 will sense the drop in water level and will retract the grinder blade 255 and de-energize the grinder motor 310 an the elevation motor 320.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "blade" is a term that is used to describe a wide and flat structure or portion of a larger structure. Non-limiting examples of object which are or which comprise blades may include a knife, a propeller, a shovel, or a cutting edge of a tool.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used herein, "energize" refers to the application of an electrical potential to a system or subsystem.

As used in this disclosure, a "housing" is a rigid casing that encloses and protects one or more devices.

As used in this disclosure, a "motor" refers to a device that transforms energy from an external power source into mechanical energy.

As used in this disclosure, "orientation" refers to the positioning and/or angular alignment of a first object relative to a second object or relative to a reference position or reference direction.

As used in this disclosure, a "plate" is a flat, rigid object having at least one dimension that is of uniform thickness and appears thinner than the other dimensions of the object. Plates often have a rectangular or disk like appearance. Plates may be made of any material but are commonly made of metal.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "rod" is a straight structure in which two dimensions of the structure appear thin relative to a third dimension of the straight structure.

As used in this disclosure, the term "shaft" is used to describe a rigid cylinder that is often used as the handle of a tool or implement. The definition of shaft explicitly includes solid shafts or shafts that comprise a hollow passage through the shaft along the center axis of the shaft cylinder, whether the shaft has one or more sealed ends or not.

As used in this disclosure, a "switch" is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch, respectively. Completing or interrupting an electric circuit is also often referred to as making or breaking the circuit, respectively.

As used in this disclosure, a "tool" is a device, an apparatus, or an instrument that is used to carry out an activity, operation, or procedure.

As used in this disclosure, "vertical" refers to a direction that is parallel to the local force of gravity. Unless specifically noted in this disclosure, the vertical direction is always perpendicular to horizontal.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A gutter debris-grinding device comprising:

a grinder, a lifter, a float, a float switch, a housing, a mounting plate, a control panel, and a battery;

wherein the gutter debris-grinding device is a tool that comminutes debris blocking a downspout;

wherein the gutter debris-grinding device couples to a rain gutter above the downspout and lowers a grinder blade into the downspout when the float switch indicates that the downspout is blocked;

wherein the electrical energy applied to a grinder motor of the grinder is controlled by the control panel;

wherein the lifter lowers the grinder when the float switch indicates that the downspout is blocked and raises the grinder when the float switch indicates that the downspout is not blocked;

wherein the float switch is coupled to a bottom of the mounting plate such that the float is suspended above the rain gutter when the rain gutter is dry;

wherein the float is oriented such that a lack of water in the rain gutter allows the float to drop down and the presence of water in the rain gutter causes the float to float up;

wherein a bottom of the housing is coupled to the mounting plate;

wherein the battery provides electrical energy to the control panel.

2. The gutter debris-grinding device according to claim 1 wherein the grinder comprises the grinder motor, a grinder shaft, and the grinder blade;

wherein the grinder motor spins the grinder blade at the end of the grinder shaft, causing the debris to be comminuted.

3. The gutter debris-grinding device according to claim 2 wherein the grinder motor converts electrical energy into mechanical energy;

wherein the grinder motor causes rotation of the grinder shaft when electrical energy is applied to the grinder motor;

wherein the grinder motor is coupled to a grinder motor mount such that vertical movement of the grinder motor mount raises and lowers the grinder motor;

wherein the grinder motor is positioned such that the axis of rotation of an elevation motor is vertically oriented;

wherein a central axis of the grinder motor protrudes from the grinder motor on the bottom of the grinder motor.

4. The gutter debris-grinding device according to claim 3 wherein the grinder shaft couples to or is an extension of the grinder motor;

wherein the lower end of the grinder shaft couples to the grinder blade such that when the grinder motor rotates, the grinder shaft will cause the grinder blade to spin.

5. The gutter debris-grinding device according to claim 4 wherein the grinder blade is a central hub coupled to a plurality of horizontally oriented tines and/or blades;

wherein the rotary motion of the grinder blade caused by the grinder motor combined with the linear up and down motion of the grinder blade caused by the elevation motor causes the grinder blade to cut and/or break the debris that it comes into contact with;

wherein as the grinder blade is moved up and down in the rain gutter and the downspout, the grinder blade eliminates the debris that is clogging the downspout.

6. The gutter debris-grinding device according to claim 5 wherein the lifter comprises the elevation motor, a leadscrew, and the grinder motor mount.

7. The gutter debris-grinding device according to claim 6 wherein the elevation motor converts electrical energy into mechanical energy;

wherein the elevation motor causes rotation of the leadscrew when electrical energy is applied to the elevation motor;

wherein the electrical energy applied to the elevation motor is controlled by the control panel;

wherein the elevation motor is coupled to the mounting plate such that the axis of rotation of the elevation motor is vertically oriented;

wherein a central shaft of the elevation motor is directly or indirectly coupled to the leadscrew.

8. The gutter debris-grinding device according to claim 7 wherein the leadscrew is a threaded rod that is vertically oriented within the housing of the gutter debris-grinding device;

wherein the leadscrew is coupled at its lower end to the elevation motor and is supported at it upper end by the housing or support struts coupled to the housing;

wherein the leadscrew is threaded through the grinder motor mount such that when the leadscrew rotates the grinder motor mount is forced to move up or down;

wherein the grinder motor mount moves up if the leadscrew is rotated in a first rotational direction;

wherein the grinder motor mount moves down if the leadscrew is rotated in a second rotational direction.

9. The gutter debris-grinding device according to claim 8 wherein the grinder motor mount is a mount for the grinder motor that raises and lowers the grinder motor responsive to rotation of the leadscrew;

wherein the grinder motor mount couples to the side of the grinder motor;

wherein the grinder motor mount is slidably coupled to the leadscrew via a vertically-oriented, threaded aperture in the grinder motor mount;

wherein the size and orientation of the thread within the grinder motor mount complement the size and orientation of the thread on the leadscrew such that the grinder motor mount is forced to move along the leadscrew when the leadscrew rotates.

10. The gutter debris-grinding device according to claim 9 wherein the float is a buoyant object coupled to the end of a float arm;

wherein the end of the float arm opposite the buoyant object is coupled to the float switch;

wherein the position of the buoyant object is sensed by the float switch and causes the float switch to make or break an electrical circuit, indicating whether or not water is accumulating in the rain gutter.

11. The gutter debris-grinding device according to claim 10 wherein the housing is an enclosure for the gutter debris-grinding device and protects the grinder motor, the elevation motor, and the battery from the weather.

12. The gutter debris-grinding device according to claim 11 wherein the housing is cylindrical in shape with a domed top.

13. The gutter debris-grinding device according to claim 11 wherein the mounting plate is a base for the gutter debris-grinding device;

wherein the mounting plate couples to the rain gutter using clips, screws, wires, magnets, friction, or other fasteners;

wherein the mounting plate comprises an aperture for the grinder shaft to pass through;

wherein the grinder blade, the float switch, the float arm, and the buoyant object are located below the mounting plate.

14. The gutter debris-grinding device according to claim 13 wherein the control panel controls the operation of the gutter debris-grinding device;

wherein the control panel monitors the state of an input from the float switch that indicates rising water in the rain gutter;

wherein responsive to the indication of rising water, the control panel energizes the grinder motor and energizes the elevation motor, causing the grinder blade to spin and to move down.

15. The gutter debris-grinding device according to claim 14 wherein the control panel periodically reverses the direction of rotation of the elevation motor such that the grinder is both raised and lowered;

wherein the reversal of direction is based upon a timing parameter, electrically sensing strain on the elevation motor at the end of travel of the grinder motor mount, by sensing input from end of travel switches adjacent to the leadscrew, or a combination thereof.

16. The gutter debris-grinding device according to claim 14 wherein the control panel causes the grinder motor and the elevation motor to operate until either the input from the float switch indicates that the water has drained from the rain gutter or until a preset time limit is reached;

wherein the control panel causes the elevation motor to stop when the grinder blade has reached its maximum height, to assure that the grinder blade is out of the way of the water and the debris flowing through the rain gutter and the downspout.

17. The gutter debris-grinding device according to claim 16 wherein the control panel comprises a processor and a memory wherein the memory contains instructions for causing the processor to control the sequence and timing of the operation of the gutter debris-grinding device.

18. The gutter debris-grinding device according to claim 16 wherein the control panel comprises one or more operator controls for manually overriding the operation of the gutter debris-grinding device.

19. The gutter debris-grinding device according to claim 18 wherein the one or more operator controls directly start or stop the grinder motor, directly start or stop the elevation motor, reset the gutter debris-grinding device, or initiate a self-test function.

20. The gutter debris-grinding device according to claim 19 wherein the battery comprises one or more energy-storage devices;

wherein the battery is a source of electrical energy to operate the grinder motor, the elevation motor, and the control panel;

wherein the battery is replaceable or rechargeable;

wherein the battery is coupled, directly or indirectly, to a power connector that is accessible on the outside of the housing;

wherein a solar panel is cabled to the power connector to provide an electrical current to recharge the battery.

* * * * *